US010800057B1

(12) United States Patent
Blake et al.

(10) Patent No.: US 10,800,057 B1
(45) Date of Patent: Oct. 13, 2020

(54) ADJUSTABLE WIDTH SAFETY RAZOR

(71) Applicants: Khashana Blake, High Point, NC (US); Sherlonda Asante, High Point, NC (US)

(72) Inventors: Khashana Blake, High Point, NC (US); Sherlonda Asante, High Point, NC (US)

( * ) Notice: Subject to any disclaimer, the term of this patent is extended or adjusted under 35 U.S.C. 154(b) by 0 days.

(21) Appl. No.: 16/846,388

(22) Filed: Apr. 12, 2020

(51) Int. Cl.
*B26B 21/22* (2006.01)
*B26B 21/52* (2006.01)
*B26B 21/40* (2006.01)

(52) U.S. Cl.
CPC ..... *B26B 21/4031* (2013.01); *B26B 21/405* (2013.01); *B26B 21/4062* (2013.01); *B26B 21/522* (2013.01); *B26B 21/222* (2013.01)

(58) Field of Classification Search
CPC . B26B 21/4031; B26B 21/405; B26B 21/522; B26B 21/4062; B26B 21/222
See application file for complete search history.

(56) References Cited

U.S. PATENT DOCUMENTS

| | | | | |
|---|---|---|---|---|
| 6,052,905 | A * | 4/2000 | Branchinelli | B26B 21/4006 30/34.1 |
| 6,308,416 | B1 | 10/2001 | Bosy et al. | |
| 8,387,259 | B2 | 3/2013 | Starr | |
| 9,289,908 | B2 | 3/2016 | Marder | |
| 9,701,033 | B2 | 7/2017 | Tracy | |
| 2007/0184011 | A1* | 8/2007 | Herlands | A61K 8/361 424/73 |

* cited by examiner

*Primary Examiner* — Stephen Choi
(74) *Attorney, Agent, or Firm* — Dale J. Ream

(57) ABSTRACT

An adjustable width safety razor and vibrator apparatus includes a main body member having an ergonomic configuration defining an interior space. The apparatus includes a primary shaving assembly having a proximal end coupled to the top end of the main body member and an open distal end and defining a first interior area. The primary shaving assembly includes an extension member slidably movable between a retracted configuration situated in the first interior area and an extended configuration extending away therefrom. A primary safety razor is coupled to the end of the extension member. First and second auxiliary shaving assemblies having an opposed mounting arms extend laterally away from the primary shaving assembly, each having an auxiliary safety razor coupled thereto. Further, a vibratory assembly may be mounted in a tip of the main body member. The primary and auxiliary safety razors are coplanar at the retracted configuration.

19 Claims, 6 Drawing Sheets

ADJUSTABLE WIDTH SAFETY RAZOR

BACKGROUND OF THE INVENTION

This invention relates generally to safety razors for shaving and, more particularly, to a safety razor having an adjustable width so that the safety razor may be used in a traditional manner or with an extended width for shaving larger areas and with fewer shaving strokes. In addition, the safety razor may include a personal vibration assembly.

Shaving can be a time consuming and inconvenient matter of personal care, especially for a woman. A woman typically shaves her legs and, sometimes, areas of her hips, abdomen, and genital area. A traditional safety razor has a width of about ⅞ inches and is appropriate for many areas being shaved. However, there are areas of a woman's body—such as the upper legs and abdomen—where the act of shaving would go much faster if a wider area of skin could be shaved; thus, fewer individual shaving strokes would be needed. In addition, a woman may desire use of a personal vibration device for personal stimulation while taking a bath or shower; however, space is limited for multiple personal devices around a bathtub or shower.

Various devices have been proposed in the art for safety razors having a wider blade. Although presumably effective for their intended purposes, there is still a need for a safety razor having an adjustable width—in other words, a safety razor that can be used to shave narrow areas as well as to shave wider areas in fewer shaving strokes. Further, a vibrator or stimulation device may be an extension device adapted for use with an electric or battery powered shaving device.

Therefore, it would be desirable to have an adjustable width safety razor that may be manually adjusted between a traditional width and an enhanced width that essentially doubles the overall width of the apparatus. Further, it would be desirable to have a vibration device integrated with the adjustable width shaving apparatus so as to provide a personal stimulation function while avoiding having multiple personal care devices where there is limited space for storage.

SUMMARY OF THE INVENTION

An adjustable width safety razor and vibrator apparatus according to the present invention includes a main body member having a bottom end and a top end opposite the bottom end, the main body member having an ergonomic configuration and defining an interior space. The apparatus includes a primary shaving assembly having a proximal end coupled to the top end of the main body member and having a distal end opposite the proximal end, the distal end being open and having a longitudinal configuration that defines a first interior area. The primary shaving assembly includes an extension member having a first end operably coupled to the distal end of the primary shaving assembly and a second end opposite the first end, the extension member being slidably movable between a retracted configuration situated in the first interior area and an extended configuration extending away from the distal end of the primary shaving assembly. A primary safety razor removably coupled to the second end of the extension member. Then, a first auxiliary shaving assembly having a first mounting arm fixedly attached to and extending laterally away from the primary shaving assembly, the first auxiliary shaving assembly having a first auxiliary safety razor coupled to a terminal end of the first mounting arm. Similarly, a second auxiliary shaving assembly having a second mounting arm fixedly attached to and extending laterally away from the primary shaving assembly, the second auxiliary shaving assembly having a second auxiliary safety razor coupled to a terminal end of the second mounting arm.

In some embodiments, the inventive apparatus includes a vibrator motor positioned proximate the bottom end and within the interior space of the main body member; the vibrator motor being operable to vibrate when actuated.

Therefore, a general object of this invention is to provide a safety razor that is adjustable between a traditional width and an enhanced width suitable for shaving faster and with fewer shaving strokes.

Another object of this invention is to provide an adjustable width safety razor, as aforesaid, in which the blade width is adjusted by retracting or extending an extension member that is coupled to a primary safety razor.

Still another object of this invention is to provide an adjustable width safety razor, as aforesaid, having a pair of auxiliary safety razors that are co-planar with the primary safety razor at the retracted configuration but are displaced from the primary safety razor at the extended configuration.

Yet another object of this invention is to provide an adjustable width safety razor, as aforesaid, that includes a handle having a vibration device that provides personal stimulation when energized.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
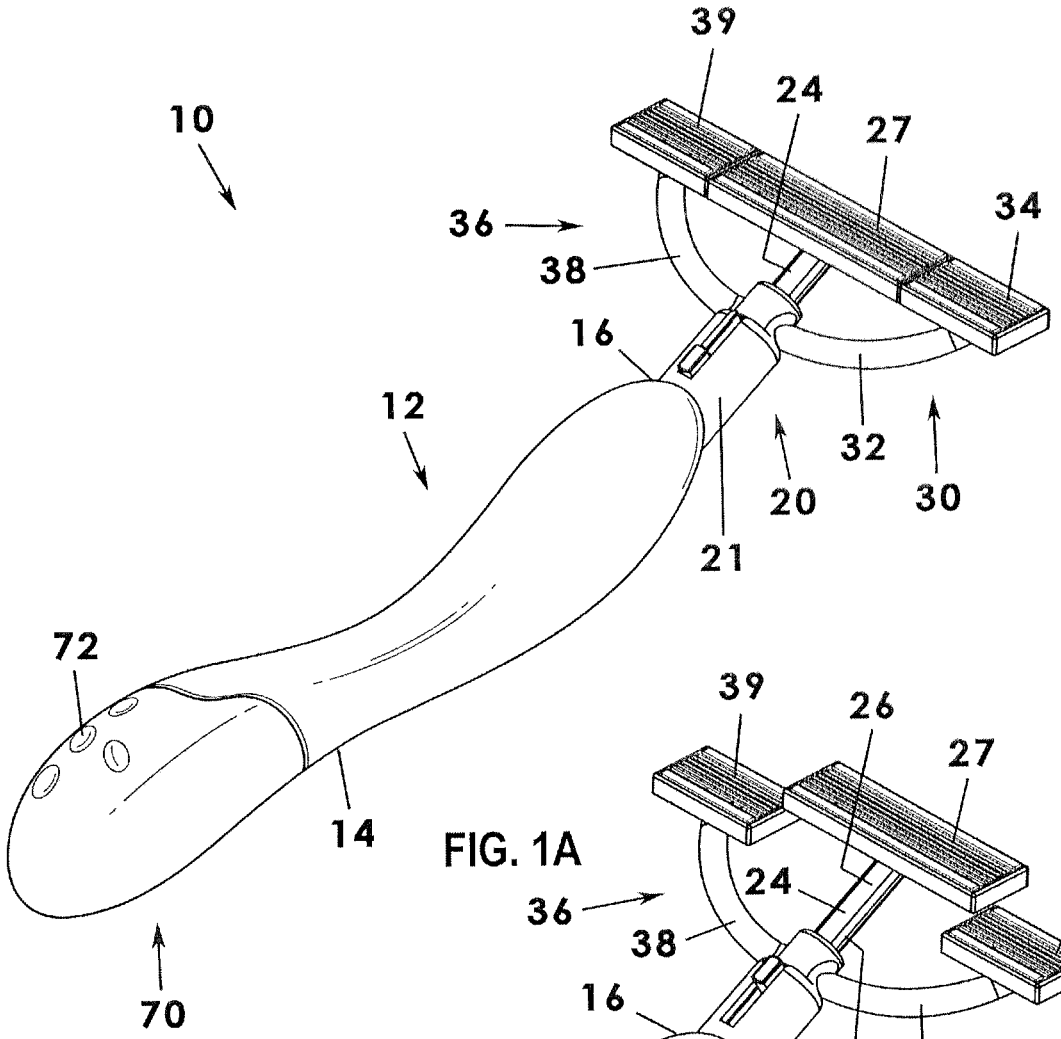
FIG. 1A is a perspective view of an adjustable width safety razor with vibration device according to a preferred embodiment of the present invention, illustrated in a retracted configuration.

An adjustable width safety razor with personal vibrator apparatus according to a preferred embodiment of the present invention will now be described with reference to FIG. 1A to 11B of the accompanying drawings. The adjustable width safety razor with personal vibrator apparatus 10 includes a main body member 12, a primary shaving assembly 20 with primary safety razor 27, a first auxiliary shaving assembly 30 with first auxiliary safety razor 34, a second auxiliary shaving assembly 36 with second auxiliary safety razor 39, and a vibration assembly 60.

The adjustable width safety razor with personal vibrator apparatus 10 includes a main body member 12 having a general structure or form common to other safety razors. More particularly, the main body member 12 is a handle having a bottom end 14 and a top end 16 opposite one another and having a continuous side wall that defines an interior space. In general, the main body member 12 may have a cylindrical configuration. Preferably, the main body member 12 is a handle having an ergonomic and slightly curved configuration and constructed of a material that is easy to grip or grasp, such by a person gripping the handle while shaving. As will be described, all or portions of the main body member 12 may be constructed of (or coated or textured with) rubber or other grippable plastic material. It is understood that this can be accomplished by adhering a rubber tip to the bottom end 14 or via an overmold technique as would be recognized by one of ordinary skill in the art and as will be described later in more detail.

Figure 11A:
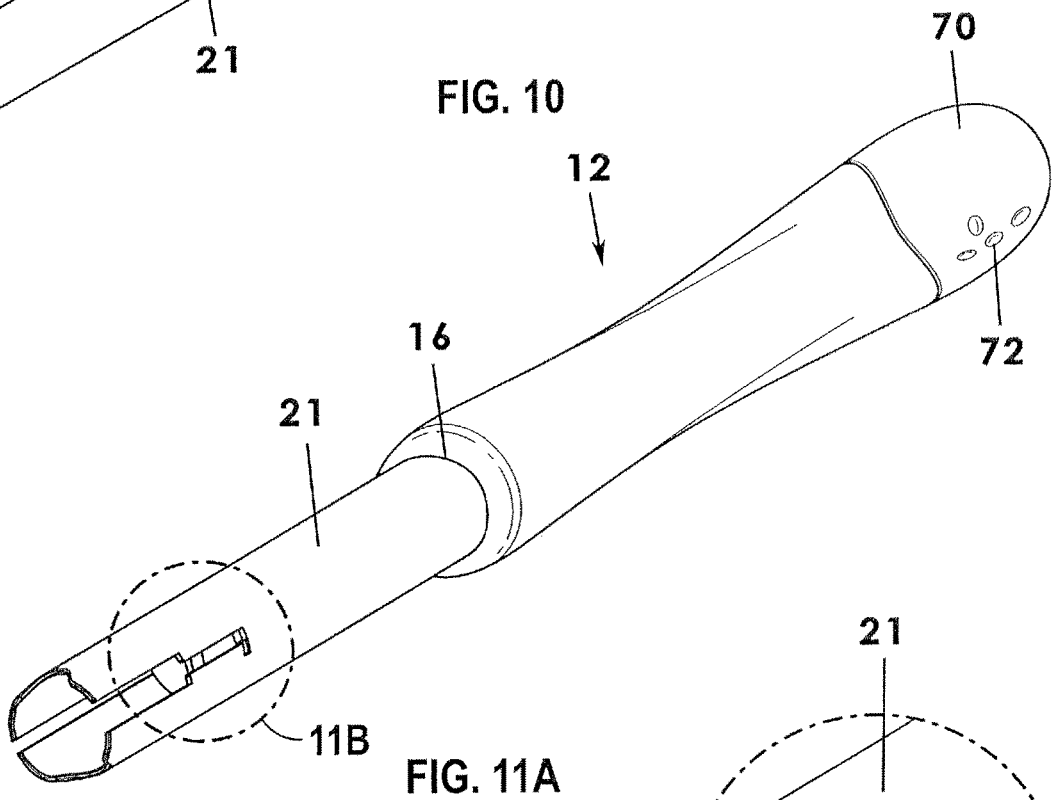
FIG. 11A is a side view of the device as in FIG. 1A.
Figure 11B:
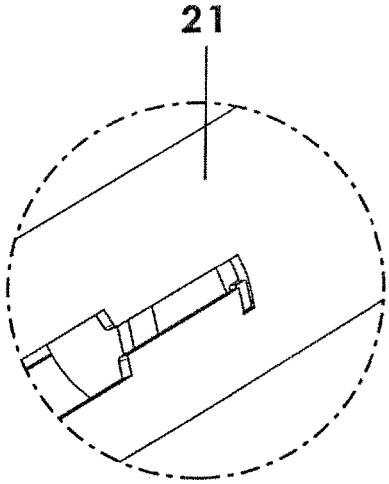
FIG. 11B is a sectional view taken along line 11B-11B of FIG. 11A.

The apparatus 10 according to the present invention includes a primary shaving assembly 20 that may include a housing 21 that is releasably or removably coupled to the top end 16 of the main body member 12, The housing has a linear and longitudinal configuration having opposed proximal and distal ends 22, 23 and defining a first interior area. It is understood that the primary shaving assembly 20 will be make reference to the housing or just to itself in general. More particularly, the top end 16 of the main body member 12 may include an opening (i.e. the top end 16 is open) into which a proximal end 22 of the housing of the primary shaving assembly 20 may be removably received, such as in a friction fit engagement (FIG. 11A). Conversely, the housing 21 may include a proximal end 22 received by the open top end 16 into the interior space defined by the main body member 12.

In an aspect that is critical to the present invention, the primary shaving assembly 20 includes an extension member 24 having a linear configuration like a rod and has a first end 25 operably coupled to the housing 21 of the primary shaving assembly 20 and has a second end 26 opposite to and extending away from the first end 25. A primary safety razor 27 is releasably coupled to the second end 26 of the extension member 24, so as to be replaceable as is the nature of safety razors. Preferably, the primary safety razor 27 may have a width of about ⅞" (inches). The extension member 24 is slidably movable through the open end of the housing 21 of the primary shaving assembly 20 between (1) a retracted configuration (FIG. 1A) in which the first end 23 and portions proximate the first end 23 are inside the first interior area of the housing 21 of the primary shaving assembly 20 and (2) an extended configuration (FIG. 1B) extending outwardly away from (i.e. outside of) the housing 21 of the primary shaving assembly 20. In other words, the extension member 24 may be moved in or out of the housing of the primary shaving assembly 20. This movement is important because a primary safety razor 27 is coupled to the second end 26 of the extension member 24 and may thus be selectively articulated in and out between retracted and extended configurations as will be described below in greater detail.

Now, in another critical aspect to the present invention, a first auxiliary shaving assembly 30 may extend away the primary shaving assembly 20 and to selectively cooperate therewith to increase a shaving width. The first auxiliary shaving assembly 30 may include a first mounting arm 32 coupled at one end to the housing 21 of the primary shaving assembly 20 and extending away therefrom to a terminal end which may be releasably coupled to a first auxiliary safety razor 34. Preferably, the first mounting arm 32 has a curved or hemispherical configuration although other configurations would also work such that the first auxiliary safety razor 34 is co-planar with the primary safety razor 27 at the retracted configuration as will be described in more detail later.

Figure 1B:
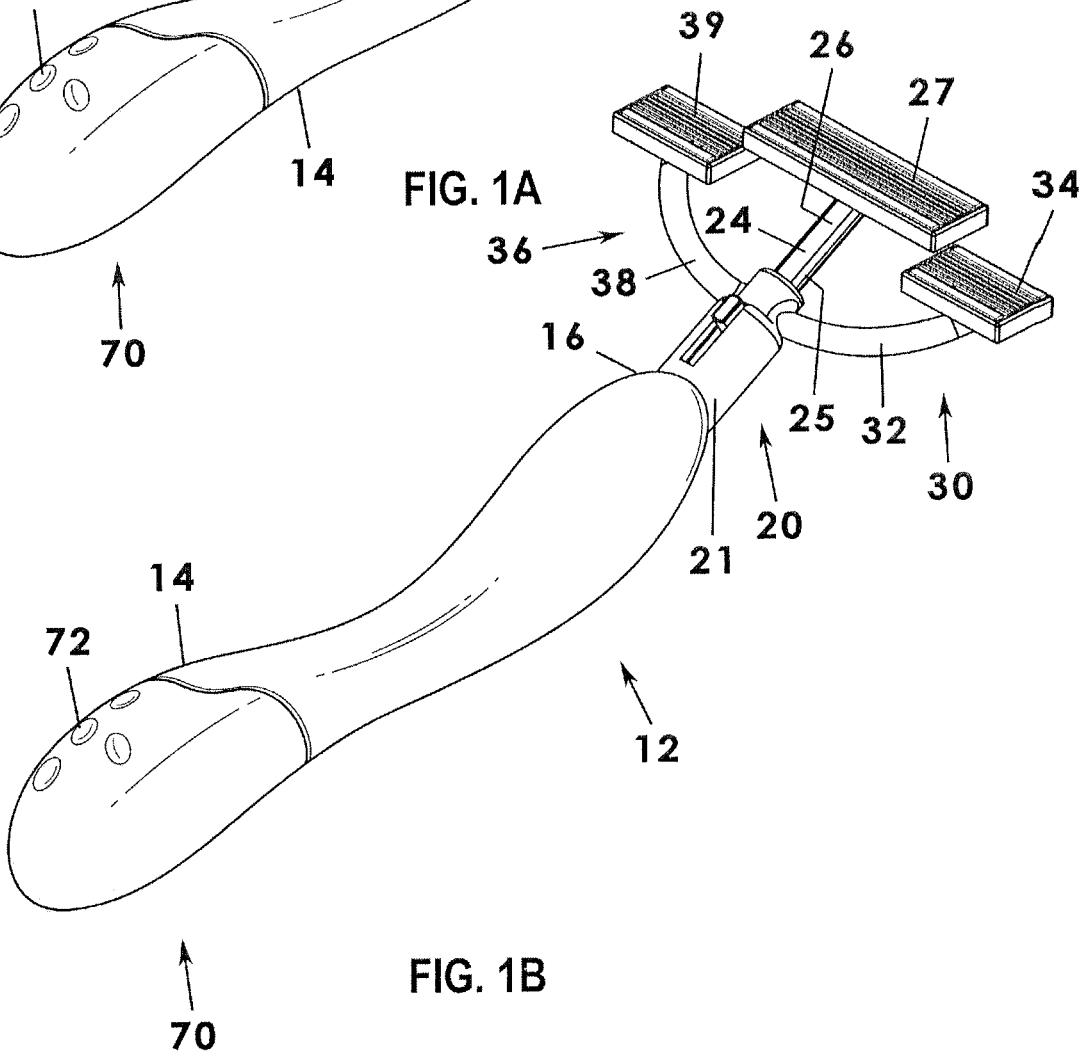
FIG. 1B is a perspective view of razor device as in FIG. 1A, illustrated in an extended configuration.
Figure 2:
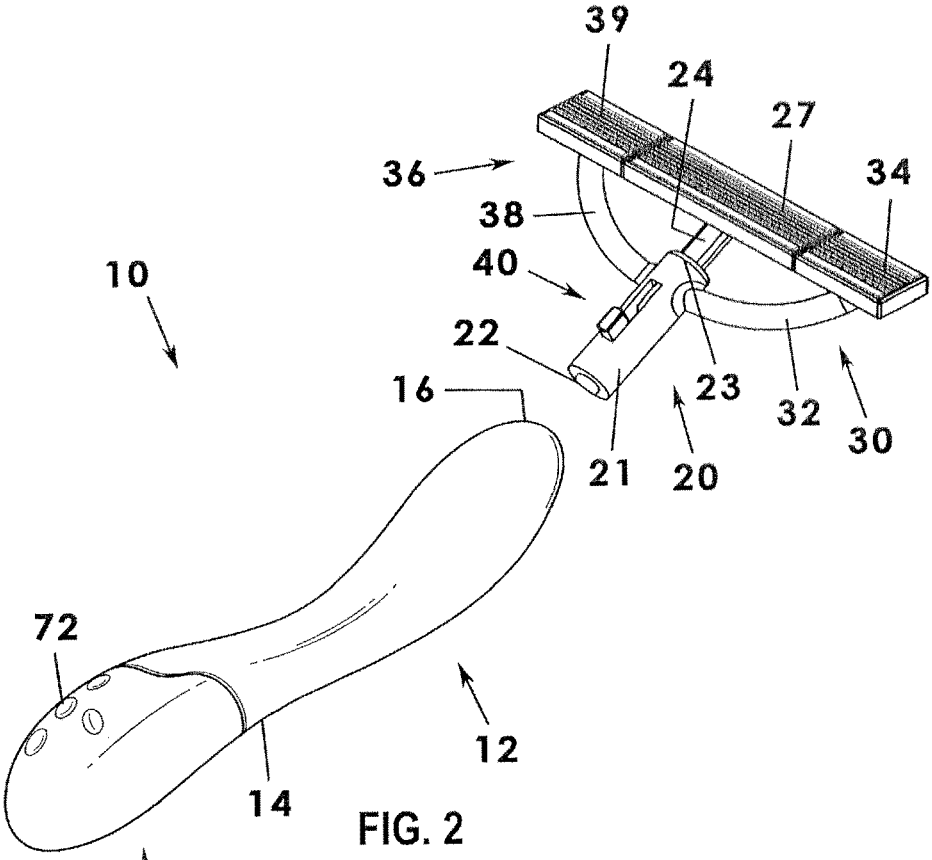
FIG. 2 is a partially exploded view of the adjustable width safety razor as in FIG. 1A, illustrated with a primary shaving assembly exploded from a main body portion.
Figure 3A:
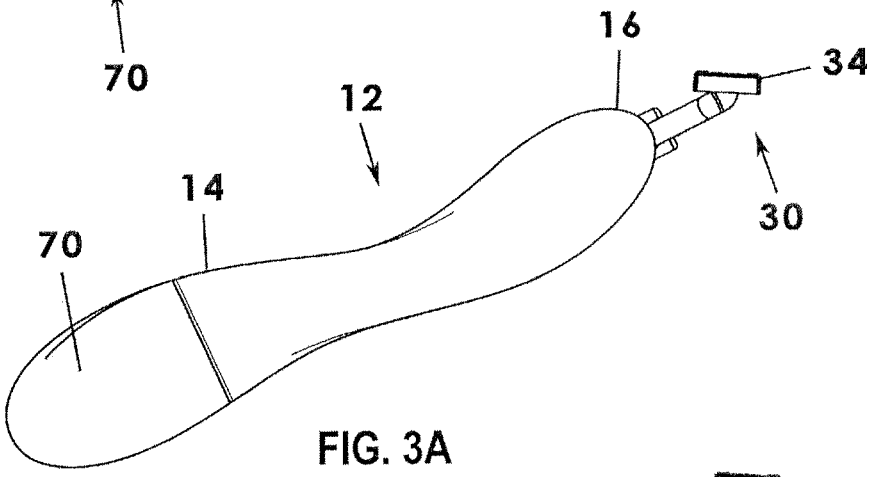
FIG. 3A is a side view of the adjustable width safety razor as in FIG. 1A, illustrated in the retracted configuration.
Figure 3B:
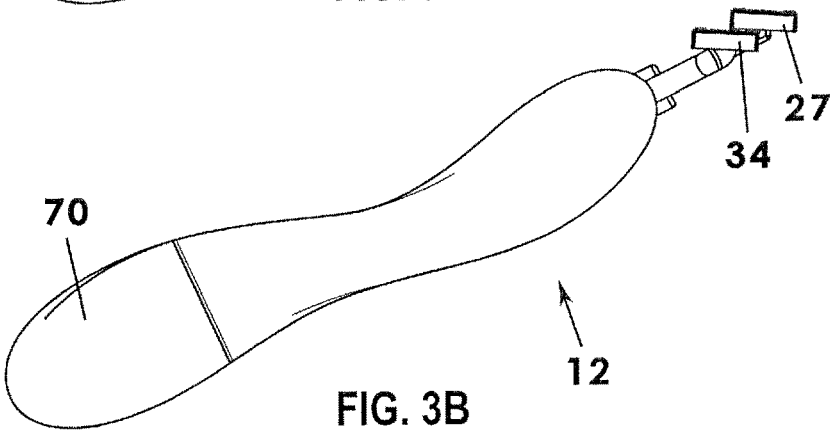
FIG. 3B is a side view of the adjustable width safety razor as in FIG. 1B, illustrated in the extended configuration.
Figure 4A:
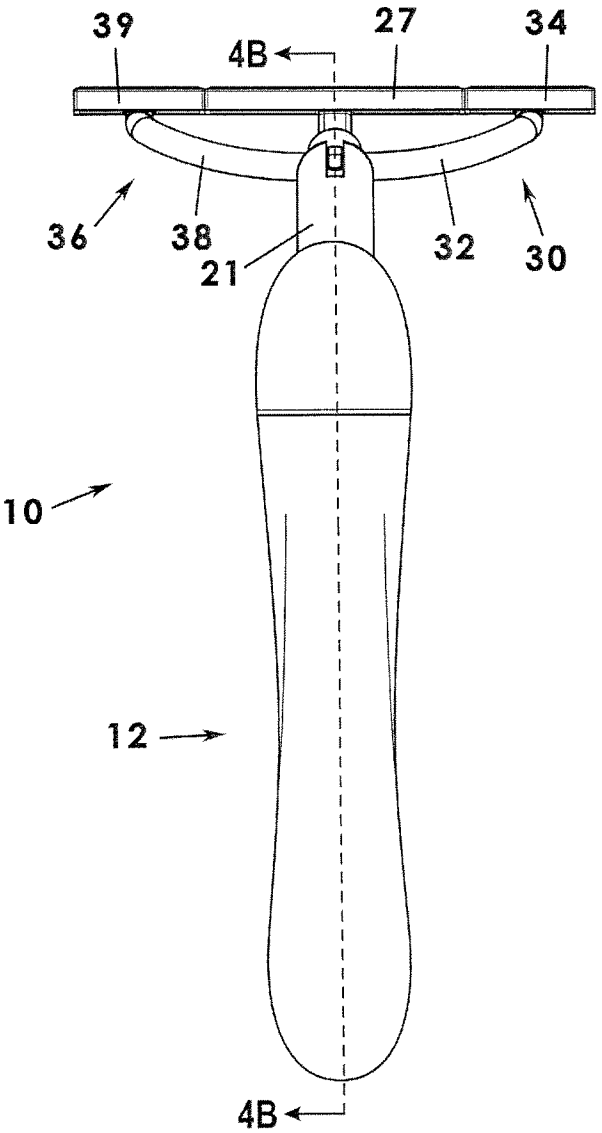
FIG. 4A is a top view of the adjustable width safety razor as in FIG. 1A.
Figure 4B:
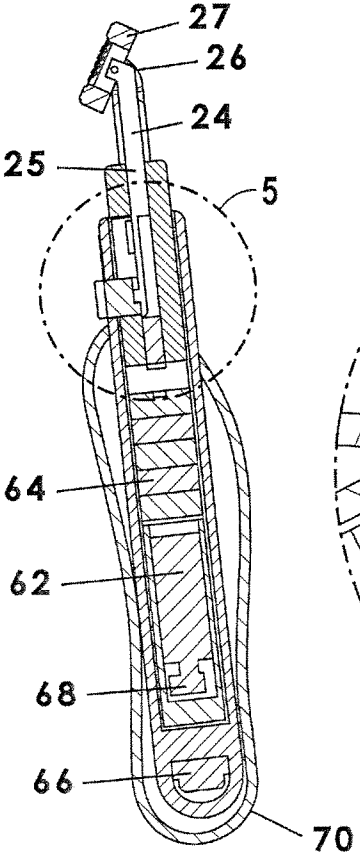
FIG. 4B is a sectional view taken along in line 4B-4B of FIG. 4A.
Figure 5:
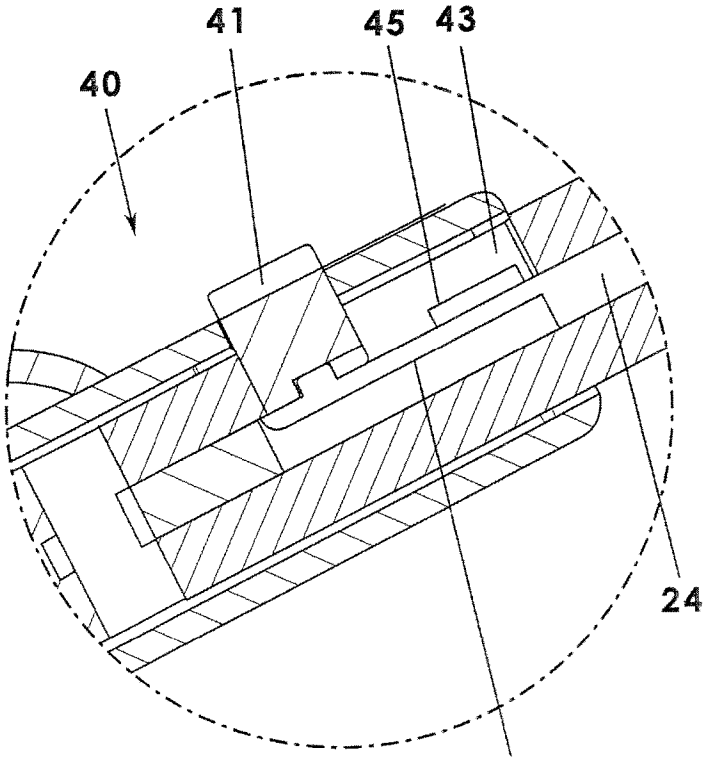
FIG. 5 is an isolated view on an enlarged scale taken from FIG. 4B.
Figure 6B:
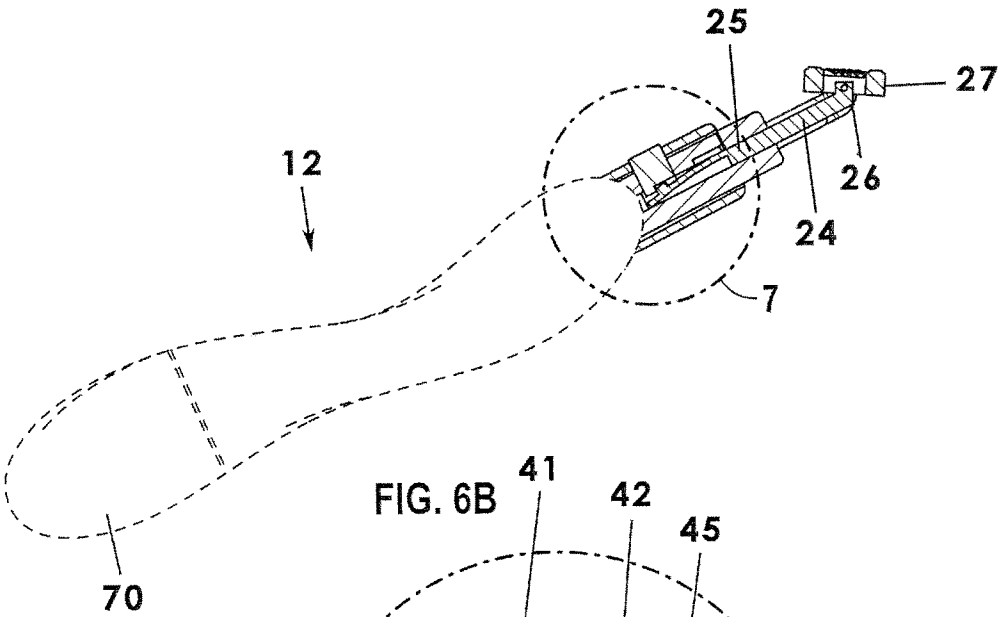
FIG. 6B is a sectional view taken along in line 5B-5B of FIG. 5A, illustrated with the actuation assembly being depressed.
Figure 7:
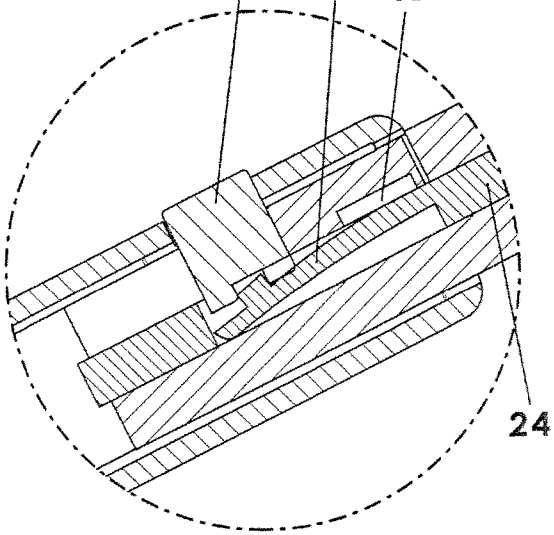
FIG. 7 is an isolated view on an enlarged scale taken from FIG. 5B.
Figure 6A:
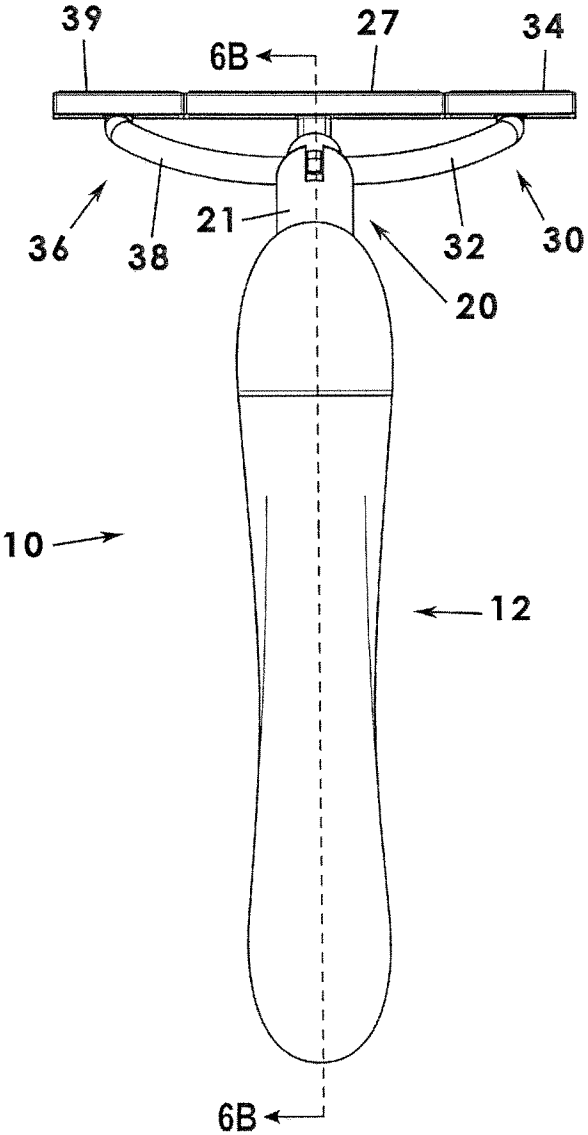
FIG. 6A is a top view of the adjustable width safety razor as in FIG. 1A.
Figure 8B:
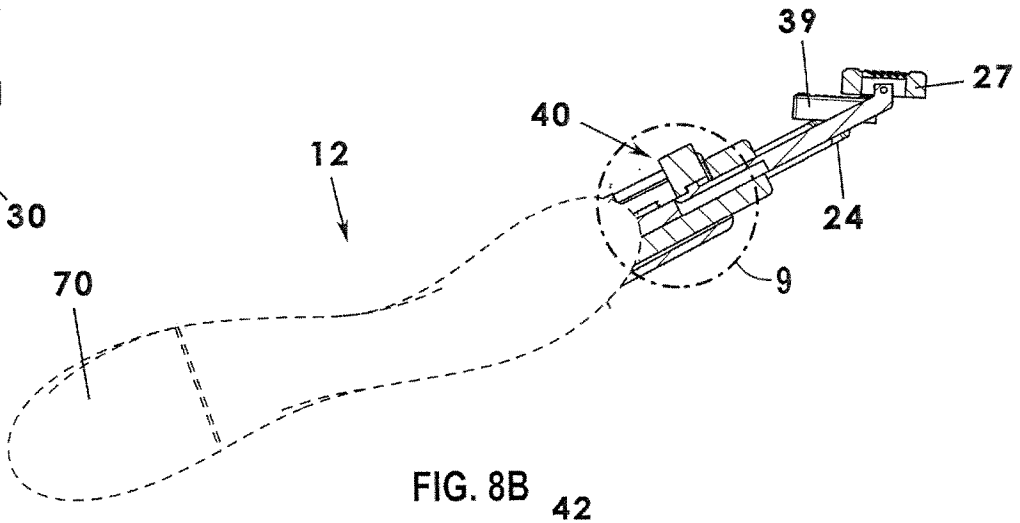
FIG. 8B is a sectional view taken along in line 8B-8B of FIG. 8A, illustrated with the actuation assembly in a forward or downstream configuration.
Figure 9:
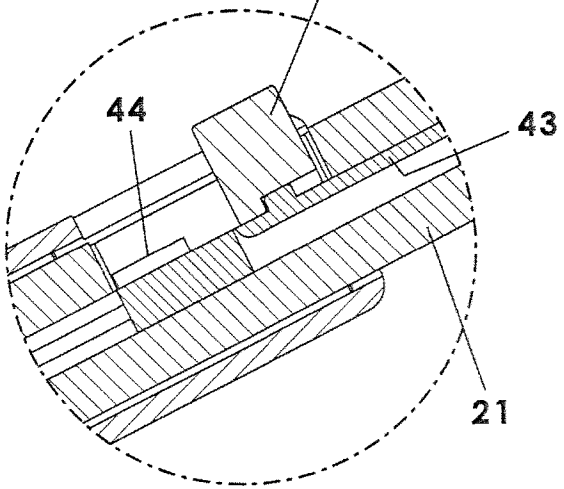
FIG. 9 is an isolated view on an enlarged scale taken from FIG. 8B.
Figure 8A:
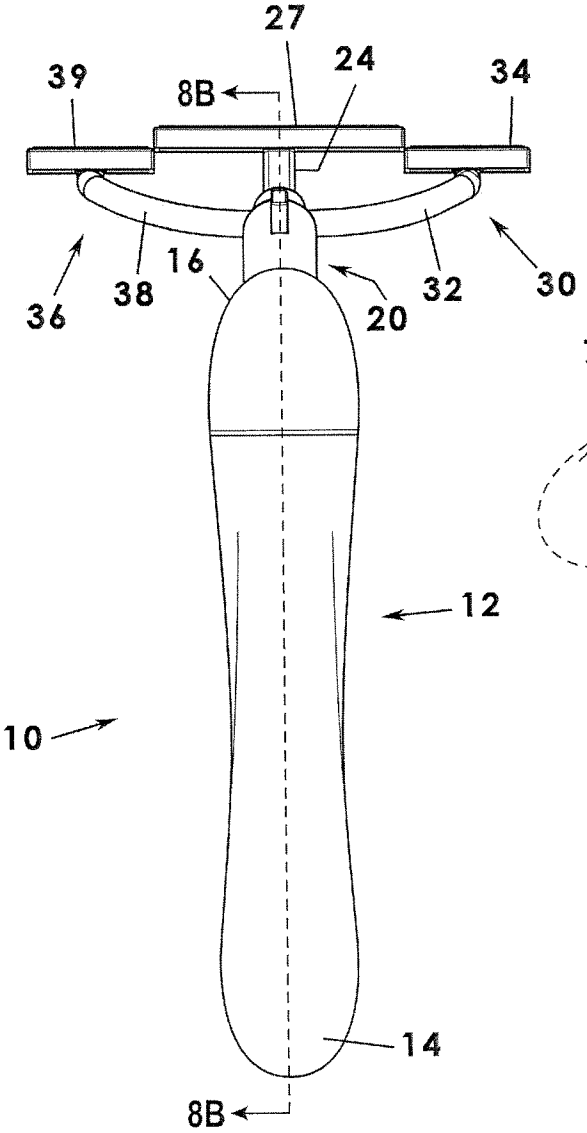
FIG. 8A is a top view of the adjustable width safety razor as in FIG. 1B.

Similarly, a second auxiliary shaving assembly 36 may extend away the primary shaving assembly 20 and to selectively cooperate therewith to increase a shaving width. The second auxiliary shaving assembly 36 may include a second mounting arm 38 coupled at one end to the housing 21 of the primary shaving assembly 20 and extending away therefrom to a terminal end which may be releasably coupled to a second auxiliary safety razor 39. It should be noted that the second mounting arm 38 extends in a direction opposite that of the first mounting arm 32. In other words, there may be a "left" auxiliary shaving assembly and a "right" auxiliary shaving assembly (FIG. 1B). Preferably, the second mounting arm 38 has a curved or hemispherical configuration (as shown) although other configurations would also work such that the second auxiliary safety razor 39 is co-planar with the primary safety razor 27 at the retracted configuration as will be described in more detail later.

Now, with more detail, the primary safety razor 27 defines a geometric plane and will be referred to as a "horizontal plane" for clarity even though it is understood that the plane may not always be horizontal as the apparatus 10 is manipulated by a user. As shown, the first auxiliary safety razor 34 is adjacent to and in-line with the horizontal plane defined by the primary safety razor 27 when the extension member 24 is at the retracted configuration. In other words, primary safety razor 27 and first auxiliary safety razor 34 are co-planar at the retracted configuration (FIG. 1A). Conversely, the primary safety razor 27 and first auxiliary safety razor 34 are not co-planar when the extension member 24 is at the extended configuration (FIG. 1B).

Similarly, the second auxiliary safety razor 39 is adjacent to and in-line with the horizontal plane defined by the primary safety razor 27 when the extension member 24 is at the retracted configuration. In other words, primary safety razor 27 and second auxiliary safety razor 39 are co-planar at the retracted configuration (FIG. 1A). Conversely, by contrast, the primary safety razor 27 and second auxiliary safety razor 39 are not co-planar when the second auxiliary safety razor 39 is adjacent to and in-line with the horizontal plane defined by the primary safety razor 27 when the extension member 24 is at the retracted configuration. It is understood that if two safety razors are not co-planar that they instead have independent or "disparate" planes. Further, it can be seen that the primary safety razor 27 is essentially sandwiched laterally between the two auxiliary safety razors when the extension member 24 is positioned at the retracted configuration (FIG. 1B). When all three safety razors are co-planar, the width of the shaving blade surface is essentially doubled to about 1.75" (inches).

In another aspect, the apparatus 10 may include an actuator 40 operably coupled to extension member 24 that enables a user to manually move the extension member 24 between the retracted configurations as described above. More particularly, the actuator 40 may include a first section 41 configured to extend outwardly through a slot defined by the housing 21 and includes a second section 42 that may be coupled to the extension member 24. The first section 41 may also be referred to as a lock slide button. In use, a user may grasp the first section 41 and urge it downstream or upstream and, accordingly, urge the extension member 24 to the extended or retracted configurations, respectively. Further, the housing 21 of the primary shaving assembly 20 defines an interior area for the actuator 40 which will be referred to as a locking pocket 43. The first and second sections combine to form a linkage for moving the extension member 24 between the opposed configurations described above. In addition, a pair of locking flanges is positioned in the locking pocket 43 and is operable to frictionally hold the linkage in either the extended or retracted configurations, respectively. More particularly, a first locking flange 44 is positioned upstream in the locking pocket 43 and may be in frictional contact with the first section 41 of the linkage and operable to hold the extension member 24 at the retracted configuration. Similarly, a second locking flange 45 is positioned downstream in the locking pocket 43 and may be in frictional contact with the first section 41 of the linkage and operable to hold the extension member 24 at the extended configuration. It will be noted that the locking button may be pushed down in order to move it forward or back, i.e. to overcome the frictional grip in the locking pocket 43 as described above and as shown in FIGS. 6B and 7.

Figure 10:
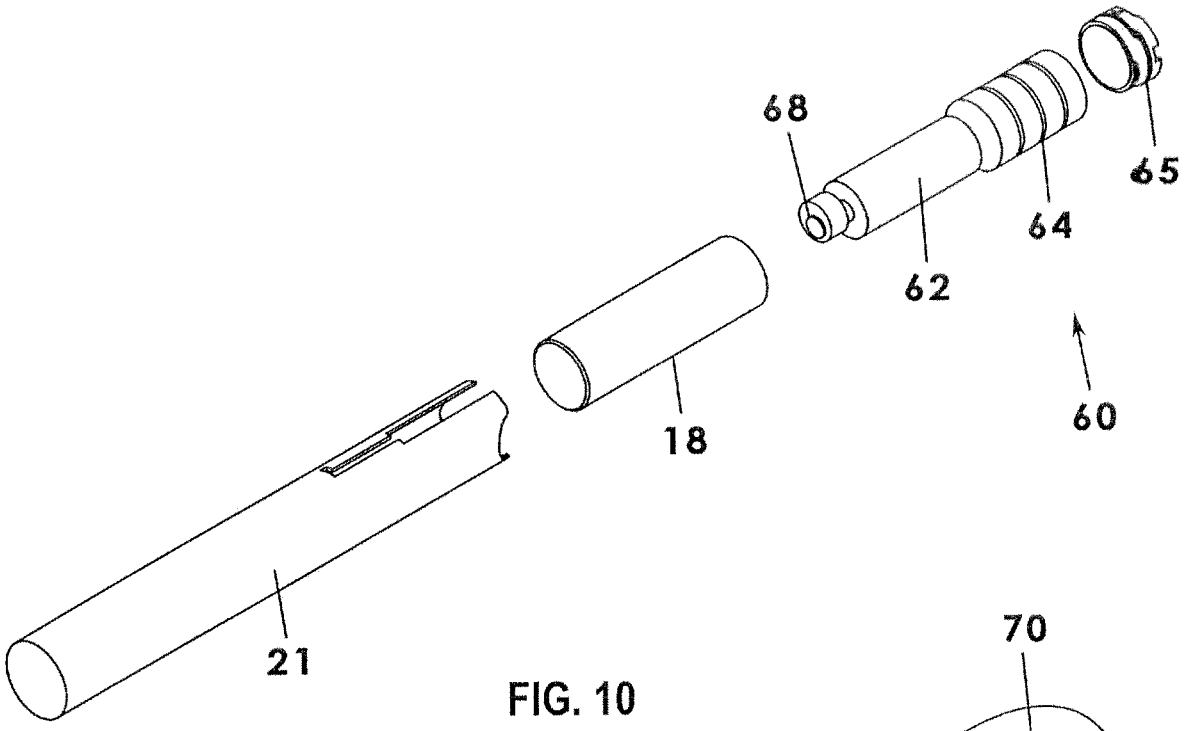
FIG. 10 is an exploded view of a vibration assembly of the device according to the present invention.

In another aspect, the apparatus 10 may include a vibration assembly 60 operable to provide a vibratory sensation to tissues of a user's body, such as to a genital area. Preferably, the vibration assembly is positioned adjacent the bottom end 14 of the main body member 12. The vibration assembly 60 may include a vibrator motor 62 positioned proximate or even adjacent the bottom end 14 of the main body member 12, i.e. within the interior space defined thereby. Preferably, the vibration assembly 60 includes at least one and, preferably, a plurality of batteries 64 electrically connected to the vibrator motor 62 for energizing the motor when actuated, such as by operation of an on/off button 66 also electrically connected to the vibration motor 62. The batteries 64 and motor 62 may be protected by being received in and protected by a motor sleeve 18 which, in turn, is received by and positioned in the interior space of the main body member 12. A battery cap 65 for accessing this area is seen in FIG. 10. In a related aspect, an eccentric weight 68 may be attached to the vibrator motor 62 or to the motor case itself to maintain the normal downward pull toward the bottom end 14 of the main body member 12. It is understood that the motor sleeve 18 and other elements of the vibration assembly 60 will be constructed so as to fit into and be received by the main body member 12.

Now with further reference to the main body member 12 proximate the bottom end 14 and relative to the vibration assembly 60, a tip portion 70 may be coupled to the bottom end 14 of the main body member 12. The tip portion 70 may include a soft, flexible material constructed of rubber or the like and that may, on the one hand, be depressed to actuate the on/off button 66 (referred to generically as a switch) positioned inside the tip portion 70, the button 66 being electrically connected to the vibrator motor 62 and operable to turning the vibrator motor 62 on or off. In an embodiment, the on/off button 66 could be positioned on the exterior (not shown). It is understood that the tip portion 70 may be a flexible housing coupled to the bottom end 14 of the main body member 12, may overlap the main body member 12 using an overmold technique where one material is partially or fully covered by another material, or have another construction known to one of ordinary skill in the art. The tip portion 70 may define an interior area operable for holding the vibrator motor 62. Further, the tip portion 70 may include a plurality of nubs 72 spaced apart upon the exterior surface thereof so as to enhance physical sensation to a user's body when the vibrator motor 62 is energized.

In use, the adjustable safety razor with personal vibrator apparatus 10 enables a user to have the option of shaving using only the primary safety razor 27 having a usual width or to retract the primary safety razor 27 to be laterally sandwiched between the first auxiliary safety razor 34 and second auxiliary safety razor 39 so as to increase the width of the blade to cover an increased area of skin during shaving. The purpose of the option of a wider blade surface, of course is to reduce the total number of strokes needed to shave one's legs, torso, or the like and, thus, to reduce the amount of time spent shaving.

In addition, the adjustable safety razor with personal vibrator apparatus 10 may include a discrete vibration assembly 60 situated at the free end of the handle that is safe and useful for providing personal enjoyment to genital regions of the body, e.g. for potential use in the shower when the device may also be used for shaving.

It is understood that while certain forms of this invention have been illustrated and described, it is not limited thereto except insofar as such limitations are included in the following claims and allowable functional equivalents thereof.

The invention claimed is:

1. An adjustable width safety razor, comprising:

a main body member having a bottom end and a top end opposite said bottom end, said main body member having a generally cylindrical configuration defining an interior space;

a primary shaving assembly that includes a housing having a proximal end received into said interior space of said main body member and a distal end opposite said proximal end and defining an opening, said primary shaving assembly having a longitudinal configuration that defines a first interior area;

wherein said primary shaving assembly includes an extension member having a first end coupled to said primary shaving assembly and a second end opposite said first end, said extension member being slidably movable between a retracted configuration situated in said first interior area and an extended configuration extending away from said housing;

a primary safety razor removably coupled to said second end of said extension member; and a first auxiliary shaving assembly having a first mounting arm fixedly attached to and extending laterally away from said housing of said primary shaving assembly, said first auxiliary shaving assembly having a first auxiliary safety razor coupled to a terminal end of said first mounting arm;

wherein said primary safety razor and said first auxiliary safety razor are adjacent to and share an auxiliary horizontal plane when said extension member is at said retracted configuration;

wherein said primary safety razor and said first auxiliary safety razor are displaced from one another and have disparate auxiliary horizontal planes when said extension member is at said extended configuration.

2. The adjustable width safety razor as in claim 1, further comprising:

a second auxiliary shaving assembly having a second mounting arm fixedly attached to and extending laterally away from said housing of said primary shaving assembly and in an opposite direction of said first mounting arm, said second auxiliary shaving assembly having a second auxiliary safety razor coupled to a terminal end of said second mounting arm;

wherein said primary safety razor and said second auxiliary safety razor are adjacent to and share said auxiliary horizontal plane when said extension member is at said retracted configuration;

wherein said primary safety razor and said second auxiliary safety razor are displaced from one another and have disparate auxiliary horizontal planes when said extension member is at said extended configuration.

3. The adjustable width safety razor as in claim 1, comprising an actuator having a first section extending away from said housing of said primary shaving assembly and having a second section coupled to said extension member, said first and second sections forming a linkage for manually moving said extension member between said retracted configuration and said extended configuration.

4. The adjustable width safety razor as in claim 3, wherein:

said primary shaving assembly defines a locking pocket adjacent said distal end and includes a first locking flange positioned in said locking pocket; and said linkage of said actuator is in frictional communication with said first locking flange when said actuator is moved to said retracted configuration.

5. The adjustable width safety razor as in claim 4, wherein:

said primary shaving assembly includes a second locking flange positioned in said locking pocket and displaced from said first locking socket member; and said linkage of said actuator is in frictional communication with said second locking flange when said extension member is moved to said extended configuration.

6. The adjustable width safety razor as in claim 2, wherein:

said primary safety razor is sandwiched between said first auxiliary safety razor and said second auxiliary safety razor when said extension member is at said retracted configuration; and said primary safety razor, said first auxiliary safety razor, and said second auxiliary razor are aligned along and co-planar with said horizontal plane when said extension member is at said retracted configuration.

7. The adjustable width safety razor as in claim 1, further comprising a vibrator assembly that includes:

a vibrator motor positioned proximate said bottom end within said interior space of said main body member; and at least one battery electrically connected to said vibrator motor and operable to energize said vibrator motor when actuated.

8. The adjustable width safety razor as in claim 7, further comprising a tip portion covering said bottom end of said main body portion, said tip portion being constructed of a rubber material.

9. The adjustable width safety razor as in claim 8, wherein:

said tip portion has an ergonomic configuration and includes a plurality of nubs; and said vibrator motor is positioned in said interior space of said main body portion immediately adjacent said tip portion.

10. The adjustable width safety razor as in claim 1, wherein said main body member includes an ergonomic configuration having a grippable surface texture.

11. An adjustable width safety razor, comprising:

a main body member having a bottom end and a top end opposite said bottom end, said main body member having an ergonomic configuration and defining an interior space;

a primary shaving assembly having a proximal end in communication with said interior space of said main body member and having a distal end opposite said proximal end, said distal end being open and having a longitudinal configuration that defines a first interior area;

an extension member having a first end operably coupled to said distal end of said primary shaving assembly and a second end opposite said first end, said extension member being slidably movable between a retracted configuration situated in said first interior area and an extended configuration extending away from said distal end of said primary shaving assembly;

a primary safety razor removably coupled to said second end of said extension member; and a first auxiliary shaving assembly having a first mounting arm fixedly attached to and extending laterally away from said primary shaving assembly, said first auxiliary shaving assembly having a first auxiliary safety razor coupled to a terminal end of said first mounting arm;

wherein said primary safety razor and said first auxiliary safety razor are adjacent to and share an auxiliary horizontal plane when said extension member is at said retracted configuration;

a vibrator motor positioned proximate said bottom end and within said interior space of said main body member; said vibrator motor being operable when actuated.

12. The adjustable width safety razor as in claim 11, further comprising:

a second auxiliary shaving assembly having a second mounting arm fixedly attached to and extending laterally away from said first portion of said primary shaving assembly and in an opposite direction of said first mounting arm, said second auxiliary shaving assembly having a second auxiliary safety razor coupled to a terminal end of said second mounting arm;

wherein said primary safety razor and said second auxiliary safety razor are adjacent to and share said auxiliary horizontal plane when said extension member is at said retracted configuration;

wherein said primary safety razor and said second auxiliary safety razor are displaced from one another and have disparate auxiliary horizontal planes when said extension member is at said extended configuration.

13. The adjustable width safety razor as in claim 12, wherein:

said primary safety razor is sandwiched between said first auxiliary safety razor and said second auxiliary safety razor when said extension member is at said retracted configuration; and said primary safety razor, said first auxiliary safety razor, and said second auxiliary razor are aligned along and co-planar with said horizontal plane when said extension member is at said retracted configuration.

14. The adjustable width safety razor as in claim 13, further comprising a tip portion coupled to said bottom end of said main body portion, said tip portion being constructed of a rubber material that is flexible.

15. The adjustable width safety razor as in claim 14, wherein:

said tip portion has an ergonomic configuration and includes a plurality of nubs; and said vibrator motor is positioned in an interior area defined by said tip portion.

16. The adjustable width safety razor as in claim 11, further comprising an activation switch positioned adjacent said bottom end and in said interior space, said activation switch being electrically connected to said vibrator motor and operable to actuate said vibrator motor.

17. The adjustable width safety razor as in claim 1, further comprising an actuator having a first section extending away from said housing of said primary shaving assembly and having a second section coupled to said extension member, said first and second sections forming a linkage for manually moving said extension member between said retracted configuration and said extended configuration.

18. The adjustable width safety razor as in claim 17, wherein:

said primary shaving assembly defines a locking pocket adjacent said distal end and includes a first locking flange positioned in said locking pocket; and said linkage of said actuator is in frictional communication with said first locking flange when said actuator is moved to said retracted configuration.

19. The adjustable width safety razor as in claim 18, wherein:

said primary shaving assembly includes a second locking flange positioned in said locking pocket and displaced from said first locking socket member; and said linkage of said actuator is in frictional communication with said second locking flange when said extension member is moved to said extended configuration.

* * * * *